US011873697B2

(12) United States Patent
Helms et al.

(10) Patent No.: US 11,873,697 B2
(45) Date of Patent: Jan. 16, 2024

(54) CASING EQUIPMENT FOR PULSED POWER DRILLING

(71) Applicants: Halliburton Energy Services, Inc., Houston, TX (US); SDG LLC, Minden, NV (US); Chevron U.S.A. Inc., San Ramon, CA (US)

(72) Inventors: Lonnie Carl Helms, Humble, TX (US); Frank Vinicio Acosta Villarreal, Spring, TX (US); Avinash Gopal Dharne, Houston, TX (US); William M. Moeny, Bernalillo, NM (US); Neal Gregory Skinner, Lewisville, TX (US)

(73) Assignees: Halliburton Energy Services, Inc., Houston, TX (US); SDG LLC, Minden, NV (US); Chevron U.S.A. Inc., San Ramon, CA (US)

( * ) Notice: Subject to any disclaimer, the term of this patent is extended or adjusted under 35 U.S.C. 154(b) by 781 days.

(21) Appl. No.: 16/965,627

(22) PCT Filed: Aug. 30, 2019

(86) PCT No.: PCT/US2019/049119

§ 371 (c)(1),
(2) Date: Jul. 29, 2020

(87) PCT Pub. No.: WO2021/040737

PCT Pub. Date: Mar. 4, 2021

(65) Prior Publication Data

US 2023/0243235 A1 Aug. 3, 2023

(51) Int. Cl.
*E21B 33/16* (2006.01)
*E21B 7/24* (2006.01)

(52) U.S. Cl.
CPC ..... *E21B 33/165* (2020.05); *E21B 7/24* (2013.01)

(58) Field of Classification Search
CPC ..... E21B 33/05; E21B 33/16; E21B 33/165; E21B 33/167
See application file for complete search history.

(56) References Cited

U.S. PATENT DOCUMENTS 5,265,680 A * 11/1993 Withers ..... E21B 47/017 166/380
5,647,434 A 7/1997 Sullaway et al.
(Continued)

OTHER PUBLICATIONS

International Search Report received for PCT Patent Application No. PCT/US2019/049119, dated May 28, 2020; 3 pages.
(Continued)

*Primary Examiner* — Giovanna Wright
(74) *Attorney, Agent, or Firm* — DeLizio, Peacock, Lewin & Guerra, LLP

(57) ABSTRACT

The present disclosure includes a plug for cementing a wellbore. The plug may include a cylinder. The cylinder may include at least one body including a non-conductive material with conductive filaments dispersed within the non-conductive material. The present disclosure also includes float equipment for cementing a wellbore. The float equipment may include a casing segment including an inner surface, drillable material affixed to the inner surface of the casing segment, and a check valve attached to the drillable material. The drillable material may include a non-conductive material and conductive filaments dispersed within the non-conductive material.

18 Claims, 14 Drawing Sheets

(56) References Cited

U.S. PATENT DOCUMENTS

| | | | | |
|---|---|---|---|---|
| 6,196,311 | B1 | 3/2001 | Treece | |
| 10,190,370 | B1 * | 1/2019 | Taha | E21B 47/005 |
| 2002/0129944 | A1 | 9/2002 | Moore et al. | |
| 2002/0157828 | A1 * | 10/2002 | King | E21B 47/01 166/250.14 |
| 2005/0028985 | A1 * | 2/2005 | Roddy | E21B 33/167 166/291 |
| 2017/0175487 | A1 | 6/2017 | Marcin et al. | |
| 2017/0292366 | A1 | 10/2017 | Ventura et al. | |

OTHER PUBLICATIONS

Written Opinion received for PCT Patent Application No. PCT/US2019/049119, dated May 28, 2020; 6 pages.

* cited by examiner

CASING EQUIPMENT FOR PULSED POWER DRILLING

PRIORITY CLAIM

The present application is a U.S. National Stage Application of International Application No. PCT/US2019/049119 filed Aug. 30, 2019, which designates the United States.

TECHNICAL FIELD

The present disclosure generally relates to casing equipment for pulsed power drilling.

BACKGROUND

Wellbores are drilled to access and produce oil, gas, minerals, and other naturally-occurring deposits from subterranean geological formations. As the wellbore is drilled, a casing is inserted into the wellbore. The casing separates the drillstring from the walls of the wellbore. At some points along the wellbore, the casing can be cemented to the walls of the wellbore.

BRIEF DESCRIPTION OF THE DRAWINGS

For a more complete understanding of the present invention and its features and advantages, reference is now made to the following description, taken in conjunction with the accompanying drawings, in which:

FIG. 14 is a cross section view of a wellbore cementing system.

DETAILED DESCRIPTION

Figure 1B:
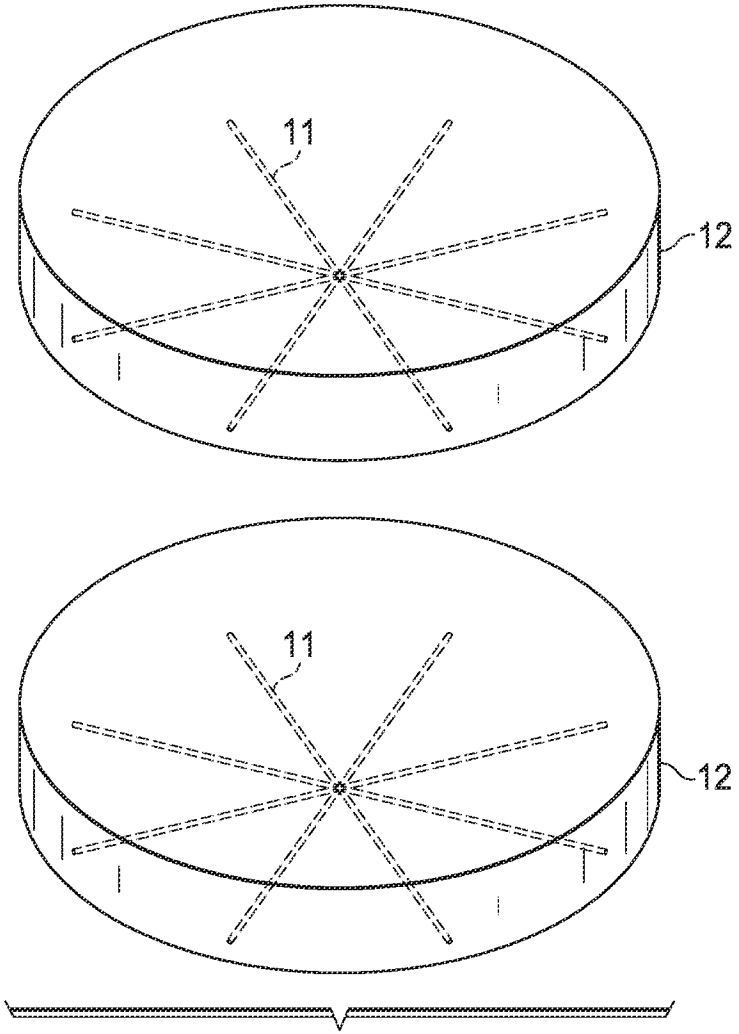
FIG. 1B is an exploded view of the blank shown in FIG. 1A.

The present disclosure provides pulsed-power drilling (PPD)-compatible composite materials for casing equipment. The present disclosure provides not only a composite material, but also casing equipment, blanks that can be machined into casing equipment components, methods of manufacturing casing equipment, systems that include the casing equipment, and methods of drilling out casing equipment using PPD.

Some casing equipment used in wellbore cementing, such as the float shoe, the float collar, the bottom plug, and the top plug, are left in the wellbore path. Both the cement and the casing equipment must be removed to continue drilling.

Rotary drilling bits can drill out conventional casing equipment left in the wellbore that pulsed-power drilling systems conventionally cannot drill out. PPD systems use a high electric potential across electrodes of a pulsed-power drill bit to fracture rock. The high electric potential across the electrodes generates an electric field powerful enough to form an electric arc through rock formations. The arc temporarily electrically couples the drill bit's electrodes, allowing electric current to flow through the arc inside the rock formation. The arc greatly increases the temperature and pressure of the portion of the rock formation through which the current flows. The elevated temperature and pressure fractures the rock. The fractured rock is carried away from the bit by drilling fluid and the bit advances down the borehole. Conventional casing equipment is often made of non-conductive materials which can prevent PPD drill bit discharges from fracturing the casing equipment.

According to the teachings of this disclosure, by forming casing equipment with conductive filaments running through the casing equipment's non-conductive material, as described herein, the electric pulses of PPD systems may travel through the casing equipment and fracture it. A filament is a conductive filament if its conductivity is at least ten times greater, or at least 100 times greater, or at least 1000 times greater, than that of the non-conductive material. Likewise, a material is a non-conductive material if its conductivity is less than one tenth that of a conductive filament that runs through it. A conductive filament may have a conductivity of between $1\times10^8$ S/m and $1\times10^7$ S/m, $1\times10^7$ S/m and $1\times10^6$ S/m, $1\times10^6$ S/m and $1\times10^5$ S/m, $1\times10^5$ S/m and $1\times10^4$ S/m, and $1\times10^4$ S/m and $1\times10^3$ S/m, inclusive. A non-conductive material may have a conductivity between $1\times10^{-8}$ S/m and $1\times10^{-7}$ S/m, $1\times10^{-7}$ S/m and $1\times10^{-6}$ S/m, $1\times10^{-6}$ S/m and $1\times10^{-5}$ S/m, $1\times10^{-5}$ S/m and $1\times10^{-4}$ S/m, $1\times10^{-4}$ S/m and $1\times10^{-3}$ S/m, $1\times10^{-3}$ S/m and $1\times10^{-2}$ S/m, $1\times10^{-2}$ S/m and $1\times10^{-1}$ S/m, 1 S/m and 10 S/m, 10 S/m and $1\times10^2$ S/m, $1\times10^2$ S/m and $1\times10^3$ S/m, $1\times10^3$ S/m and $1\times10^4$ S/m, and $1\times10^4$ S/m and $1\times10^5$ S/m, inclusive.

PPD-suitable casing equipment may be made by machining blanks formed from non-conductive material with conductive filaments dispersed in non-conductive material. The blanks may be right circular cylinders, as depicted in FIGS. 1-9, or they may be another shape suitable for machining, such as barrel-shaped or hollow cylinders.

Figure 8:
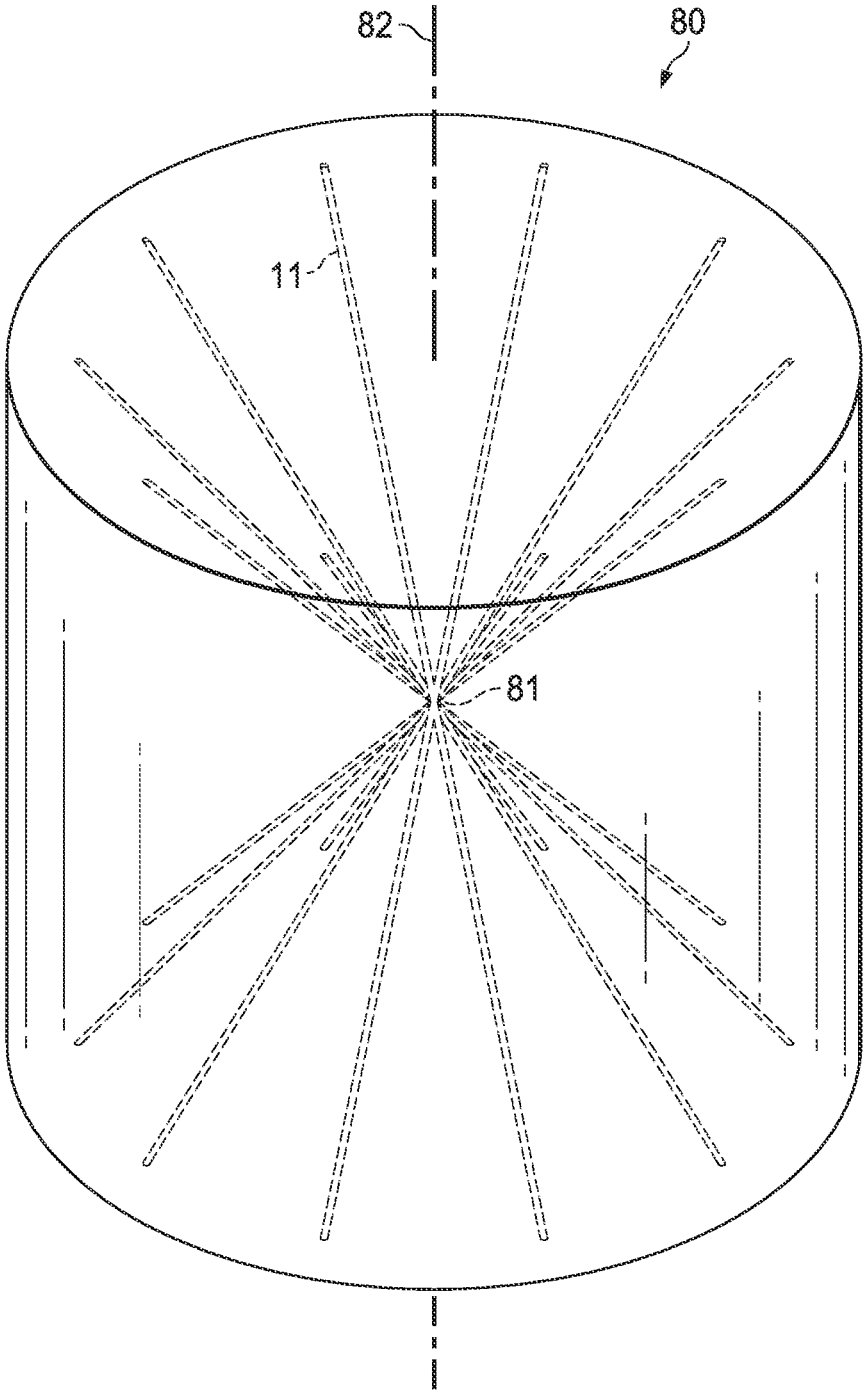
FIG. 8 is a perspective view of a blank containing conducting filaments.
Figure 9:
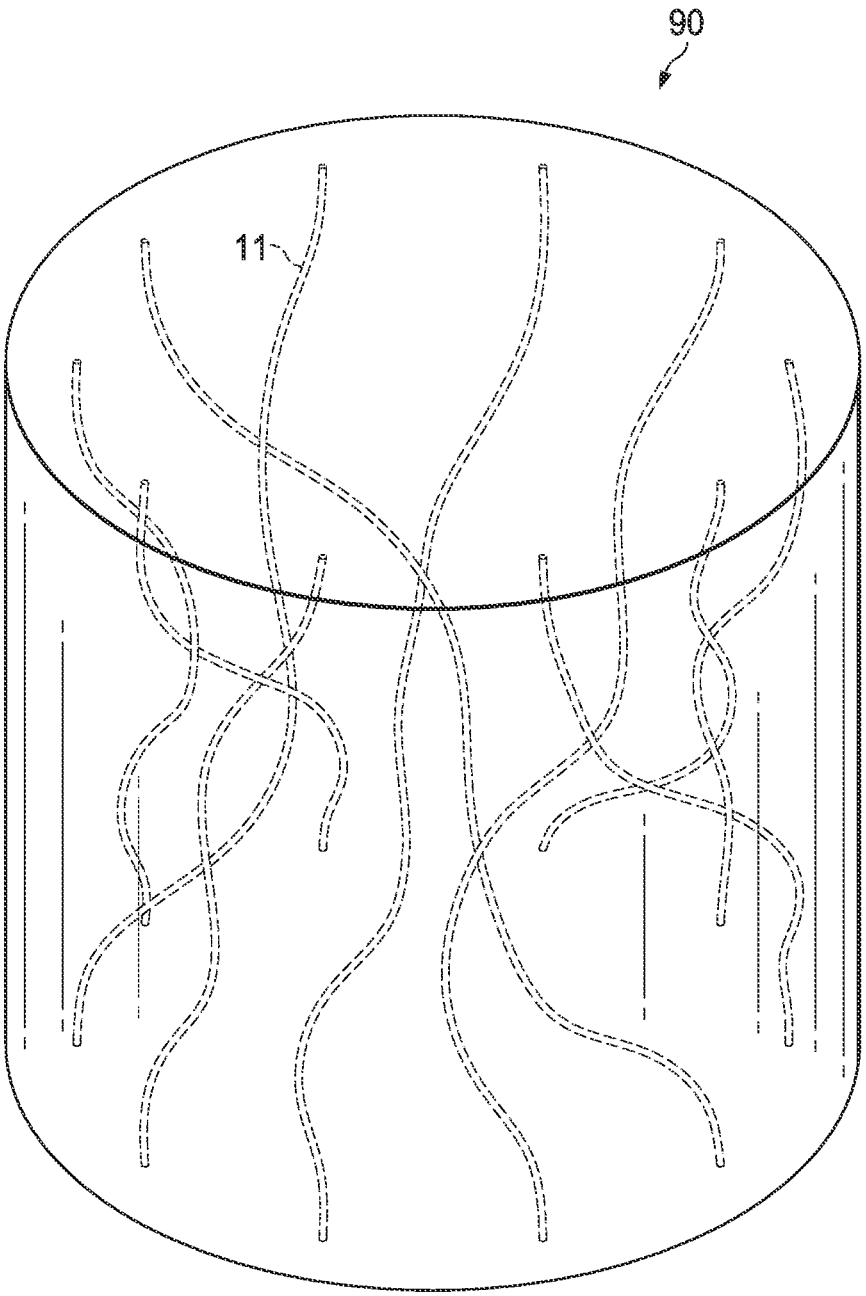
FIG. 9 is a perspective view of a blank containing conducting filaments.
Figure 11:
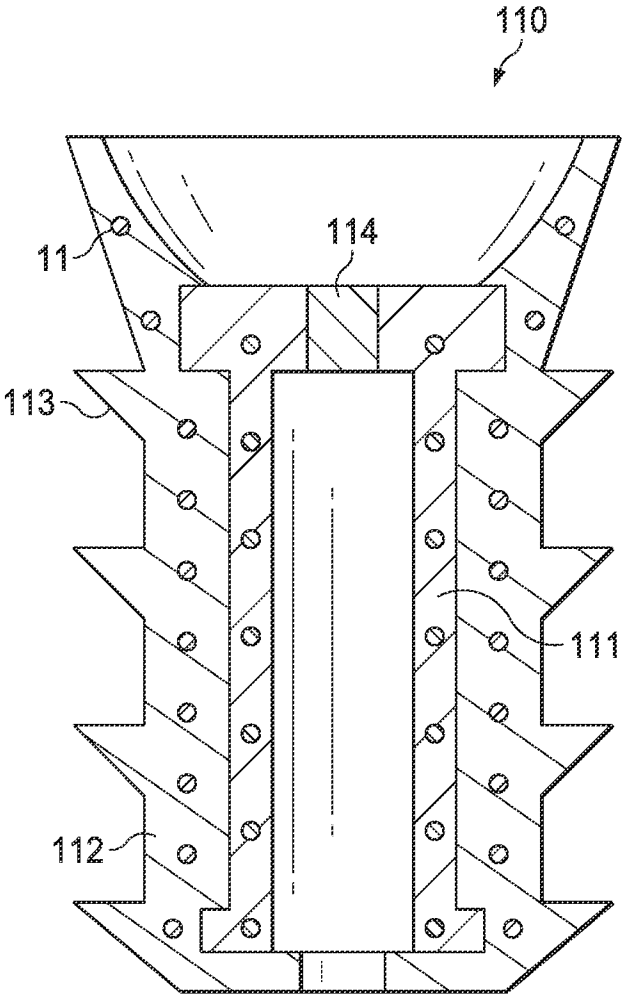
FIG. 11 is a cross section view of a bottom plug containing conducting filaments.
Figure 10:
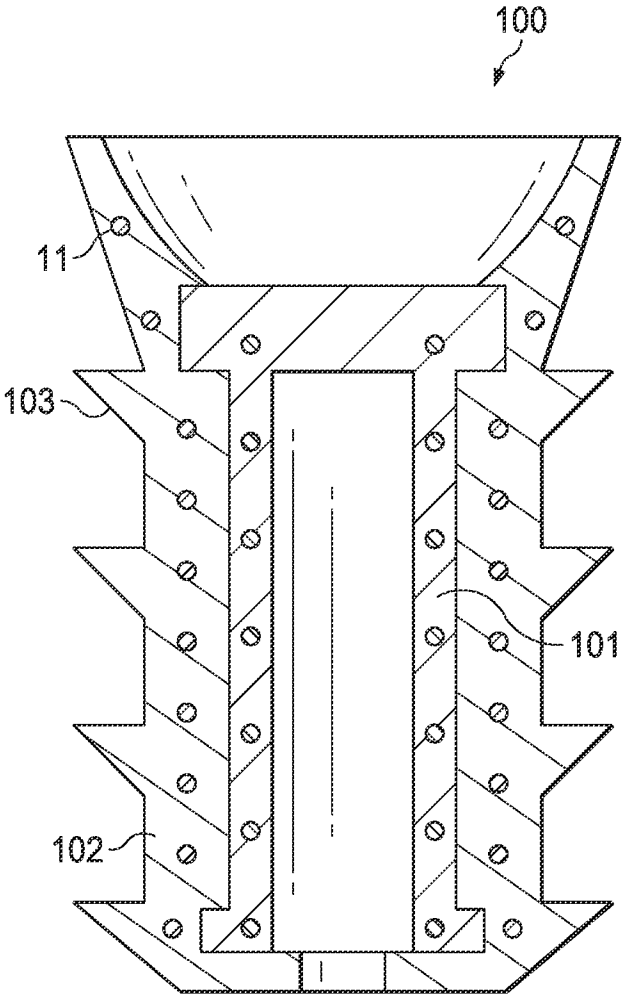
FIG. 10 is a cross section view of a top plug containing conducting filaments.
Figure 12:
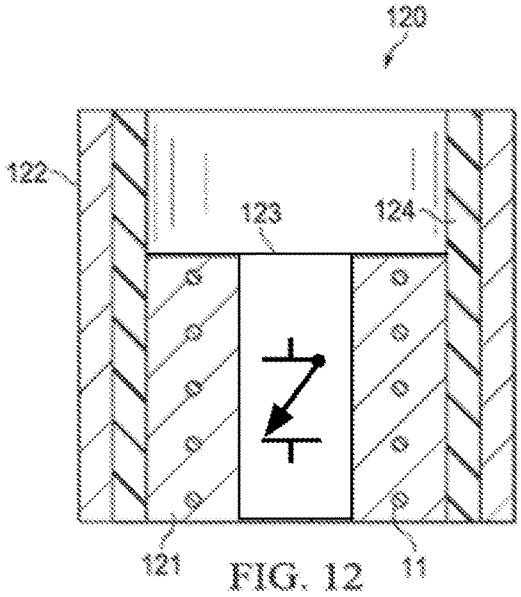
FIG. 12 is a cross section view of a float collar containing conducting filaments.

The blanks shown in FIGS. 1-9 and casing equipment shown in FIGS. 10-12 include non-conductive material with conductive filaments 11 dispersed in the non-conductive material, rendering them PPD-compatible.

Non-conductive material may include concrete, ceramic, composite materials, such as fiberglass-reinforced plastic, and polymers, such as polyurethane, resin, plastic, and rubber, and any combinations thereof.

Conductive filaments may be formed from any conductive material that can form thin filaments. For example, conductive filaments may be include metals or metal alloys, such as aluminum, copper, iron, beryllium, titanium, gold, magnesium, manganese, nickel, platinum, tungsten, zinc, silver, alloys thereof, and any combinations thereof.

Conductive filaments may have a diameter of between 1 mm and 5 mm, between 5 mm and 4 mm, between 4 mm and 3 mm, between 3 mm and 2 mm, between 2 mm and 1 mm, between 1 mm and 0.5 mm, between 0.5 mm and 0.4 mm, between 0.4 mm and 0.3 mm, between 0.3 mm and 0.2 mm, between 0.2 mm and 0.1 mm, between 0.1 mm and 0.01 mm, or between 0.01 and 0.001 mm, inclusive.

Conductive filaments are dispersed in the non-conductive material so an electrical pulse from a PPD drill bit may flow through a conductive filament, heat it, and fragment the non-conductive material.

Conductive filaments may be dispersed in the non-conductive material using any suitable method. For example, holes may be drilled through the non-conductive material and then conductive filaments may be threaded through the holes.

Conductive filaments may be dispersed in the non-conductive material by using a form to hold filaments in place, pouring or injecting either molten non-conductive material or a resin into the form, and then letting the non-conductive material either set or cure. The form may be, for example, a mold. The filaments may be held in place by, for example, a porous foam.

If the non-conductive material is fiberglass-reinforced plastic, conductive filaments may be dispersed in the non-conductive material by weaving the conductive filaments into the fiberglass before resin is added to form the fiberglass-reinforced plastic.

Figure 1A:
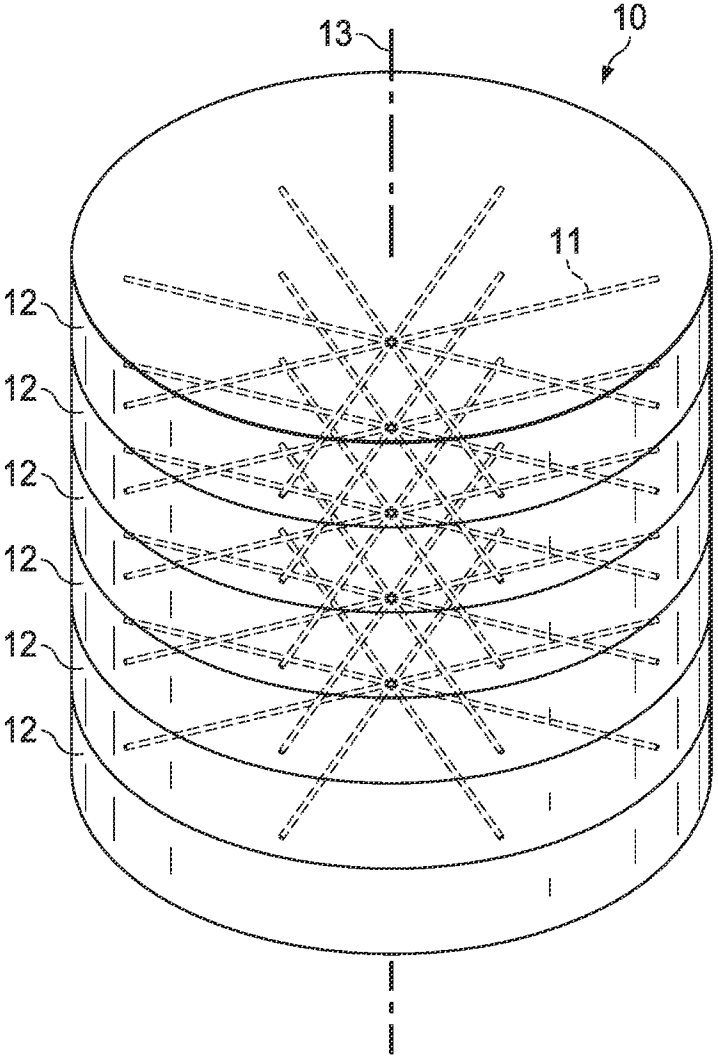
FIG. 1A is a perspective view of a blank containing conducting filaments.

FIG. 1A is a perspective view of blank 10. Blank 10 includes non-conductive material with conductive filaments 11 dispersed in the non-conductive material. Blank 10 may be formed of layers 12 of non-conductive material, or it may be a single piece. Conductive filaments 11 may be dispersed between all layers 12, as shown, or only some layers 12. Conductive filaments 11 in blank 10 may be dispersed radially about the cylinder axis 13 at regular intervals, as shown, or the intervals may be irregular. Conductive filaments 11 may be dispersed homogeneously or heterogeneously. Layers 12 may be affixed together by gluing, epoxying, heating, or any other suitable method to form blank 10. Conductive filaments 11 are dispersed so an electrical pulse from a PPD drill bit may flow through conductive filament 11, heat it, and fragment blank 10. FIG. 1B is an exploded view of FIG. 1A, and shows conductive filaments 11 between each layer 12 of blank 10.

Figure 2B:
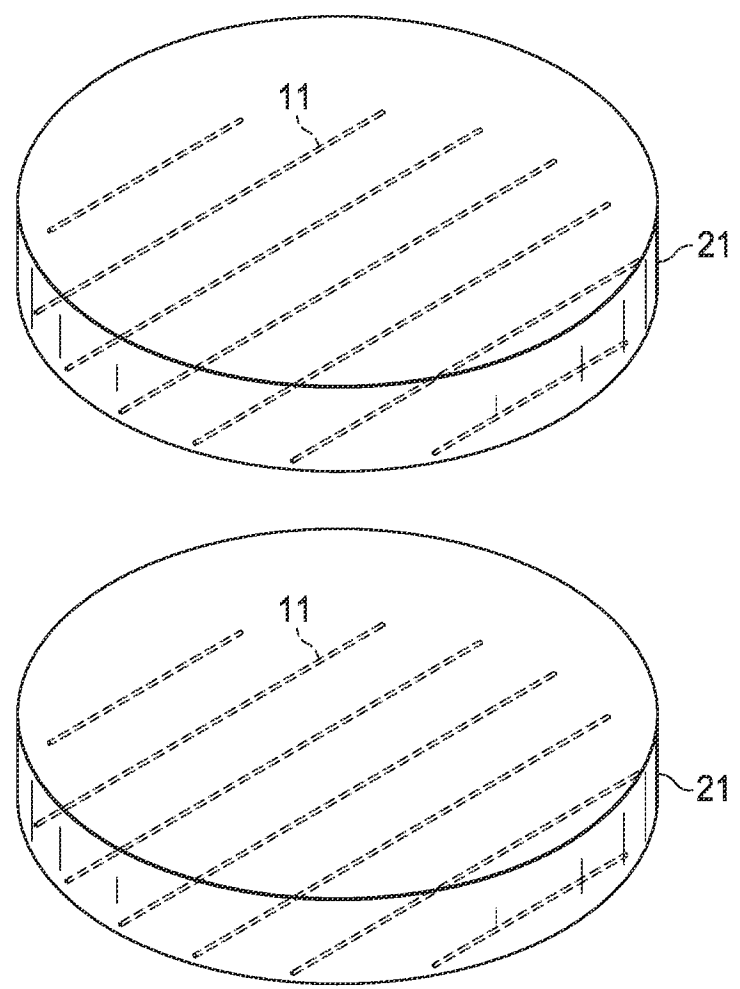
FIG. 2B is an exploded view of the blank shown in FIG. 2A.
Figure 2A:
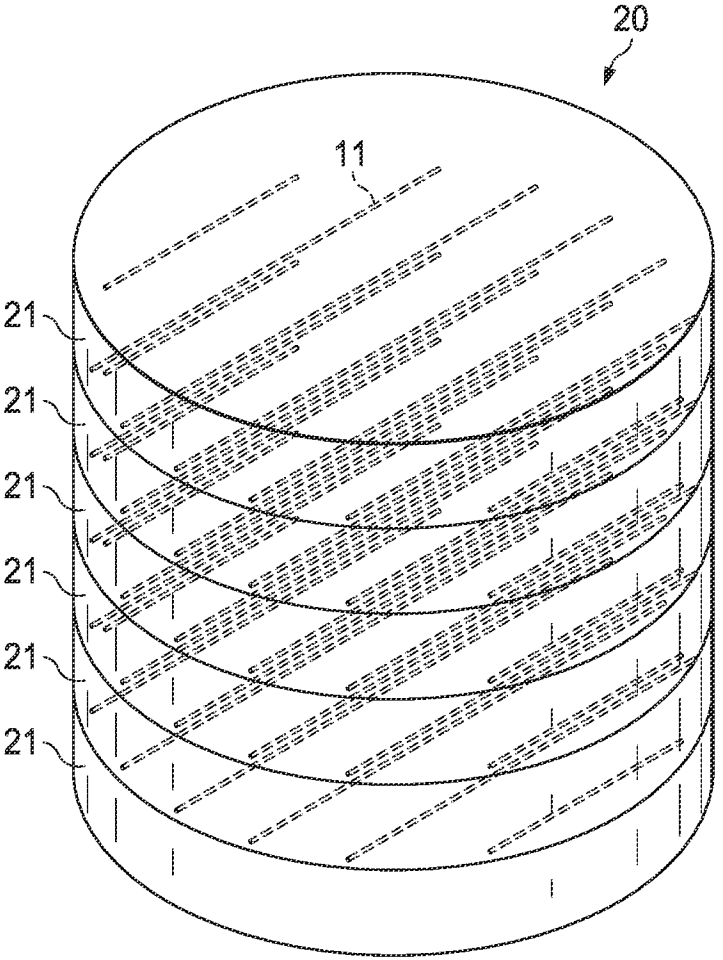
FIG. 2A is a perspective view of a blank containing conducting filaments.

FIG. 2A is a perspective view of blank 20. Blank 20 includes non-conductive material with conductive filaments 11 dispersed in the non-conductive material. Blank 20 may be formed of layers 21 of non-conductive material, or it may be a single piece. Conductive filaments 11 may be dispersed between all layers 21, as shown, or only some layers 21. Conductive filaments 11 in blank 20 may be dispersed in a regular series of parallel lines, as shown, or the lines may be irregularly spaced and may not be parallel. Conductive filaments 11 may be dispersed homogeneously or heterogeneously. Layers 21 may be affixed together by gluing, epoxying, heating, or any other suitable method to form blank 20. Conductive filaments 11 are dispersed so an electrical pulse from a PPD drill bit may flow through conductive filament 11, heat it, and fragment blank 20. FIG. 2B is an exploded view of FIG. 2A, and shows conductive filaments 11 between each layer 21 of blank 20.

Figure 3B:
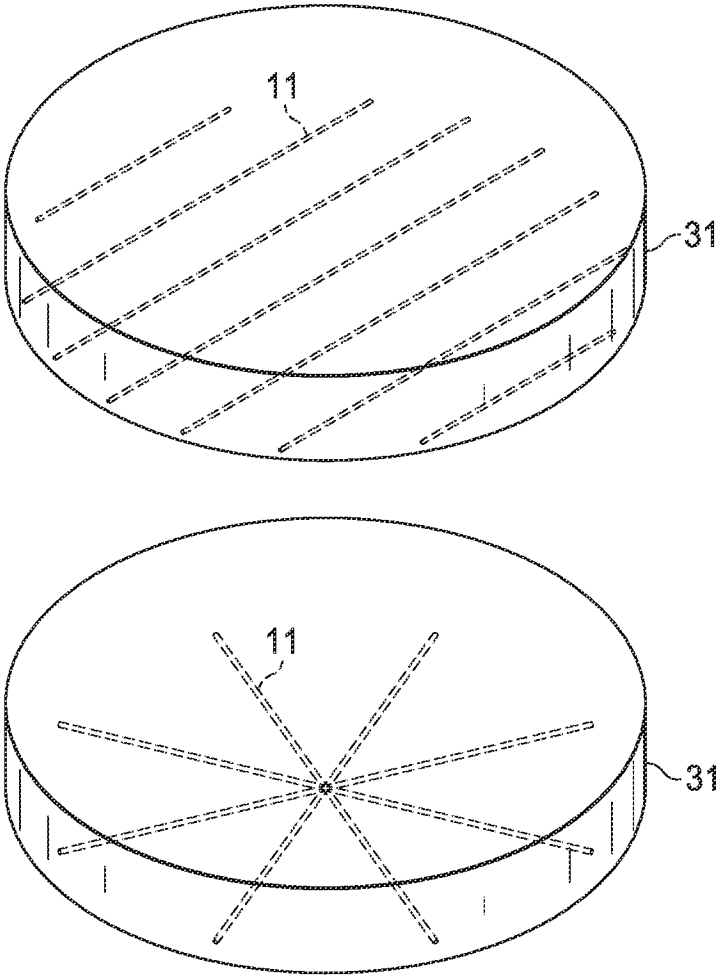
FIG. 3B is an exploded view of the blank shown in FIG. 3A.
Figure 3A:
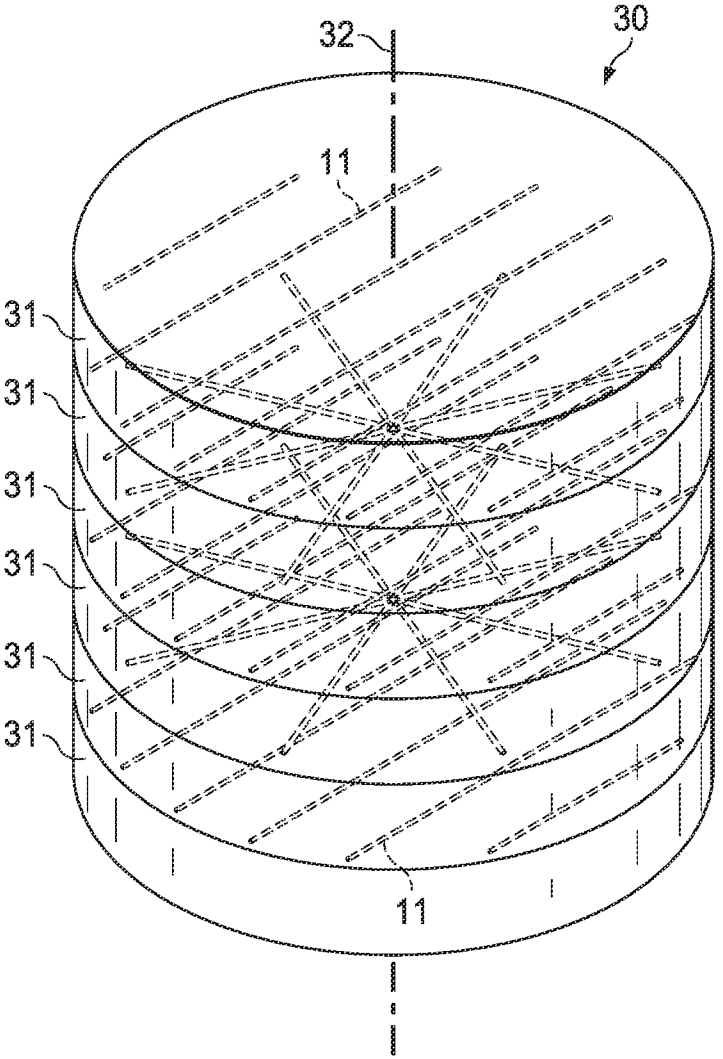
FIG. 3A is a perspective view of a blank containing conducting filaments.

FIG. 3A is a perspective view of blank 30. Blank 30 includes non-conductive material with conductive filaments 11 dispersed in the non-conductive material. Blank 30 may be formed of layers 31 of non-conductive material, or it may be a single piece. Conductive filaments 11 may be dispersed between all layers 31, as shown, or only some layers 31. Conductive filaments 11 in blank 30 may alternate between being dispersed radially about cylindrical axis 32 and being dispersed in a regular series of parallel lines, as shown, or they may alternate between different patterns or may not alternate. Conductive filaments 11 may be dispersed homogeneously or heterogeneously. Layers 31 may be affixed together by gluing, epoxying, heating, or any other suitable method to form blank 30. Conductive filaments 11 are dispersed so an electrical pulse from a PPD drill bit may flow through conductive filament 11, heat it, and fragment blank 30. FIG. 3B is an exploded view of FIG. 3A, and shows conductive filaments 11 between each layer 31 of blank 30.

Figure 4B:
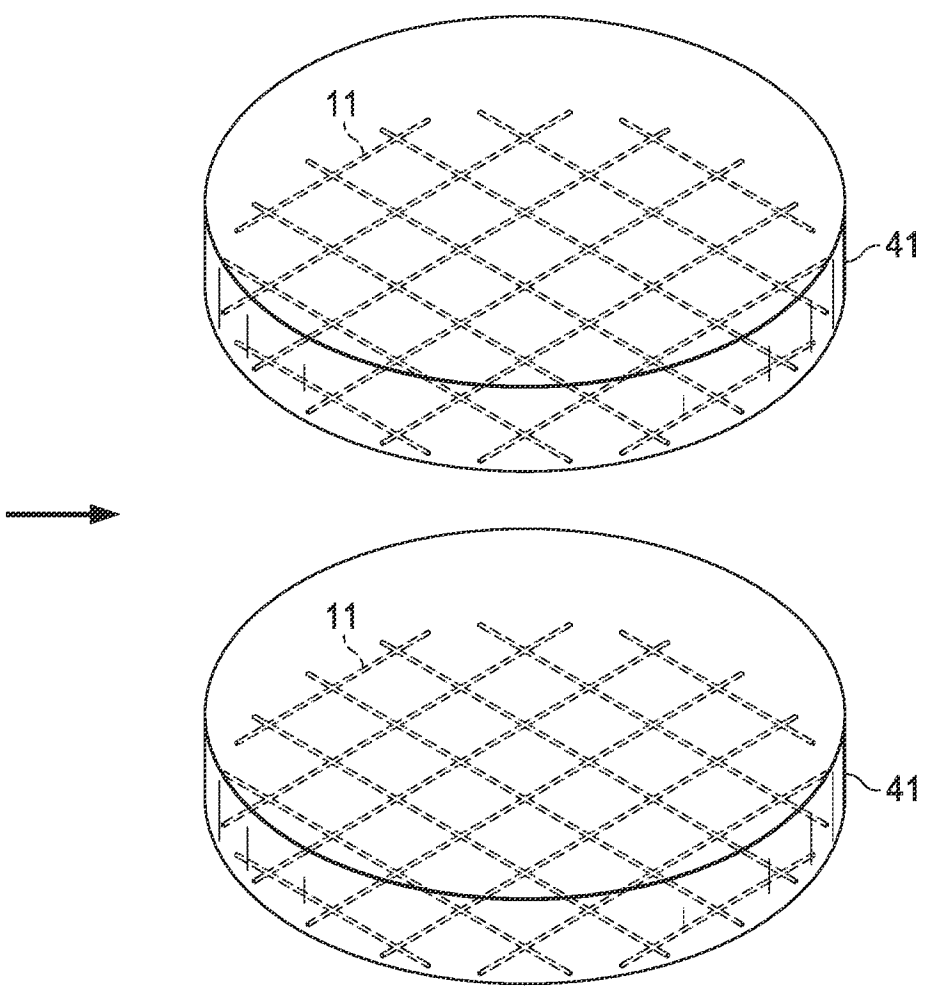
FIG. 4B is an exploded view of the blank shown in FIG. 4A.
Figure 4A:
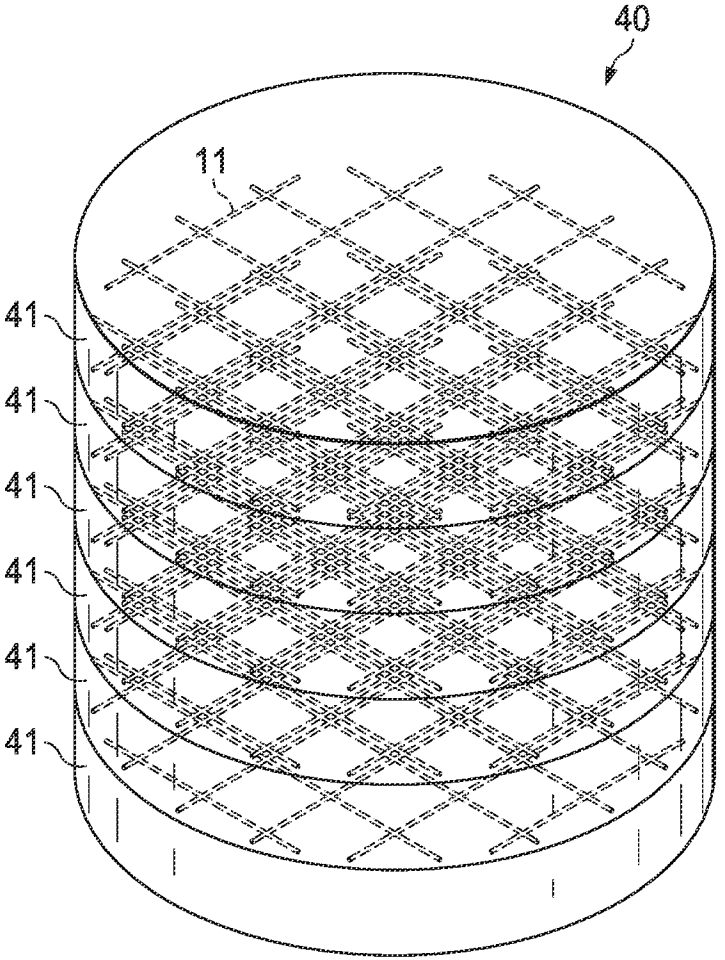
FIG. 4A is a perspective view of a blank containing conducting filaments.

FIG. 4A is a perspective view of blank 40. Blank 40 includes non-conductive material with conductive filaments 11 dispersed in the non-conductive material. Blank 40 may be formed of layers 41 of non-conductive material, or it may be a single piece. Conductive filaments 11 may be dispersed between all layers 41, as shown, or only some layers 41. Conductive filaments 11 in blank 40 may be dispersed in a regular 2-dimensional grid, as shown, or the grid may be irregular. Conductive filaments 11 may be dispersed homogeneously or heterogeneously. Layers 41 may be affixed together by gluing, epoxying, heating, or any other suitable method to form blank 40. Conductive filaments 11 are dispersed so an electrical pulse from a PPD drill bit may flow through conductive filament 11, heat it, and fragment blank 40. FIG. 4B is an exploded view of FIG. 4A, and shows conductive filaments 11 between each layer 41 of blank 40.

Figure 5:
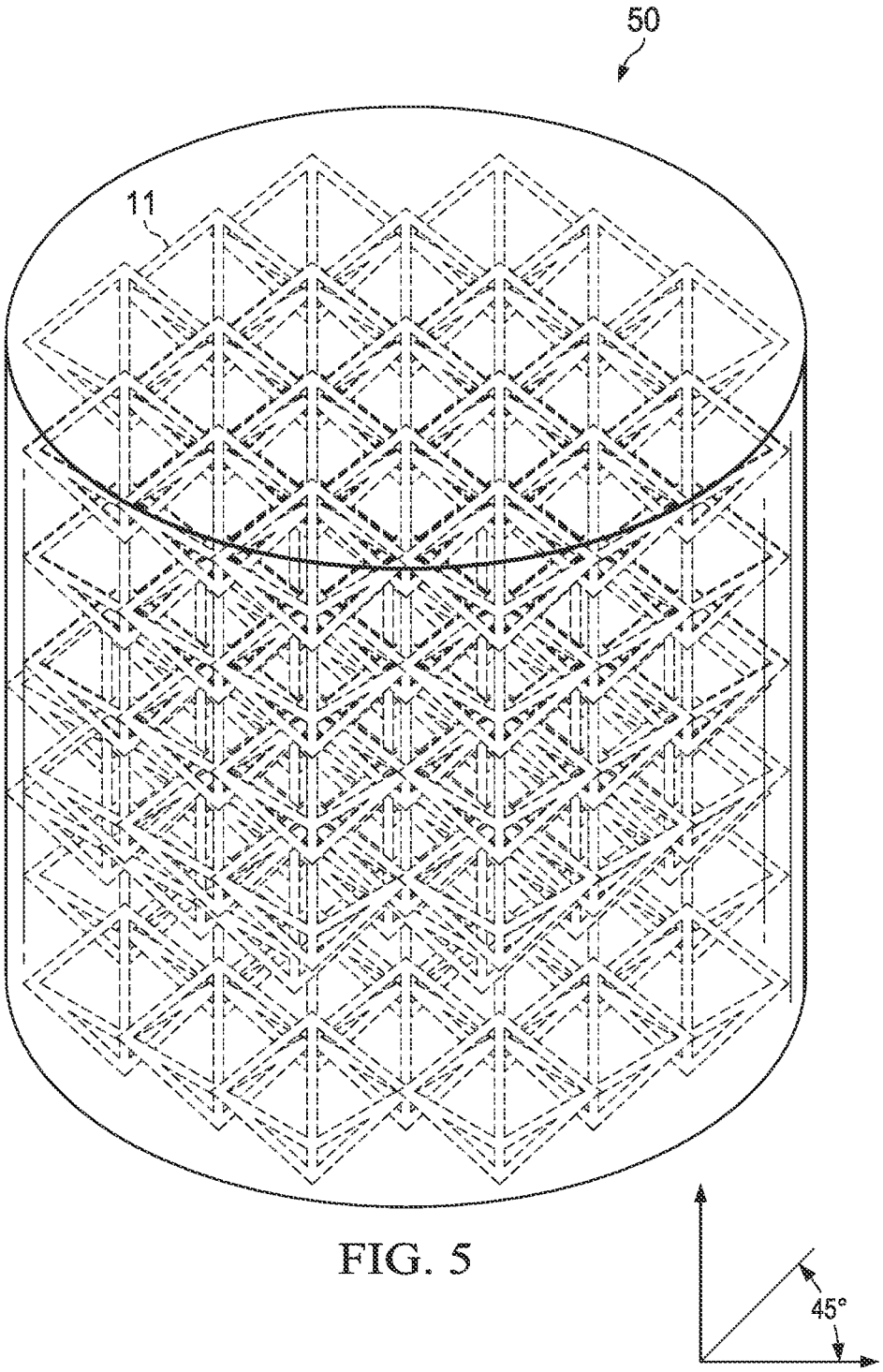
FIG. 5 is a perspective view of a blank containing conducting filaments.

FIG. 5 is a perspective view of blank 50. Blank 50 includes non-conductive material with conductive filaments 11 dispersed in the non-conductive material. Conductive filaments 11 in blank 50 may be dispersed in a regular 3-dimensional grid at a 45° angle to the base of blank 50, as shown, or the grid may be irregular and may be disposed at any other angle relative to the base. Conductive filaments 11 may be dispersed homogeneously or heterogeneously. Conductive filaments 11 are dispersed so an electrical pulse from a PPD drill bit may flow through conductive filament 11, heat it, and fragment blank 50.

Figure 6:
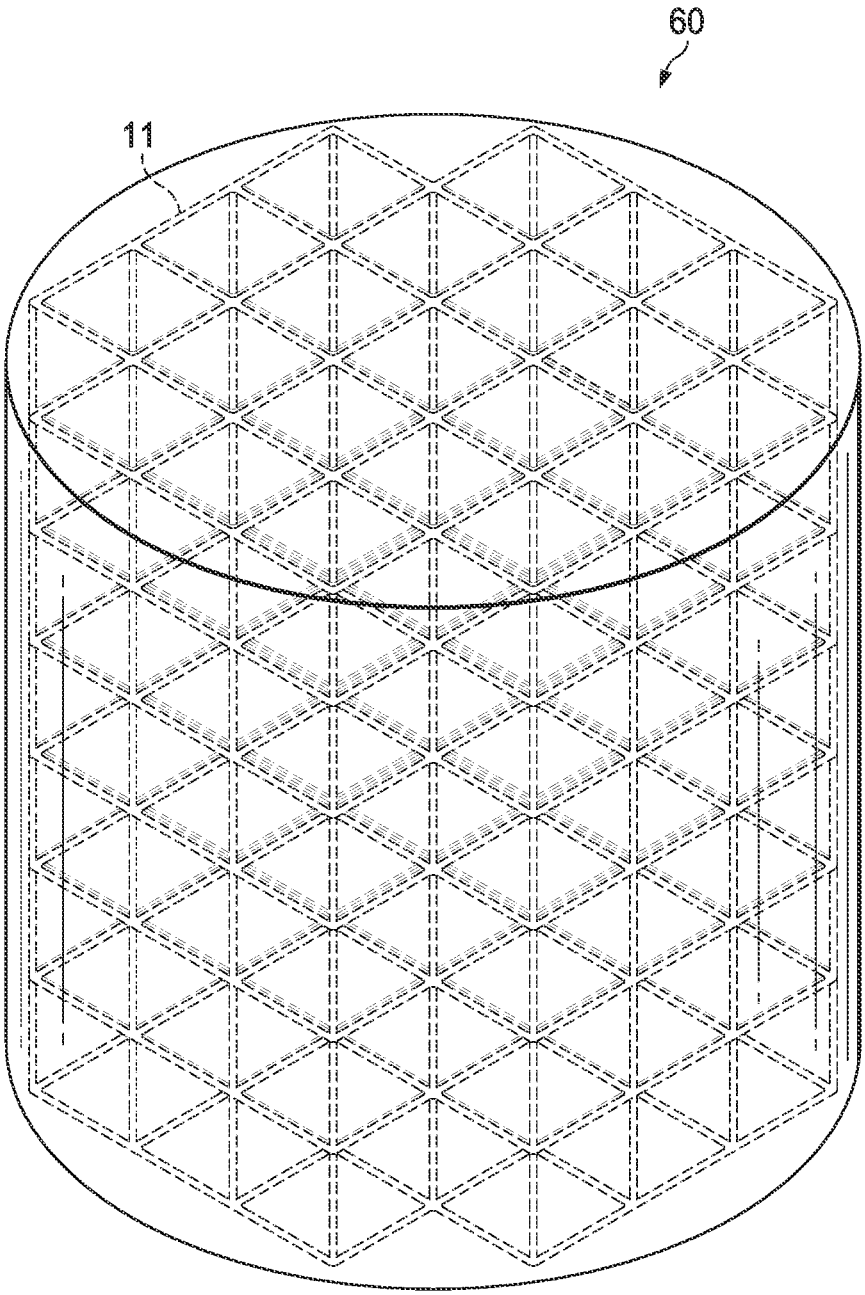
FIG. 6 is a perspective view of a blank containing conducting filaments.

FIG. 6 is a perspective view of blank 60. Blank 60 includes non-conductive material with conductive filaments 11 dispersed in the non-conductive material. Conductive filaments 11 in blank 60 may be dispersed in a regular 3-dimensional grid pattern at right angles, or parallel to, to the base of blank 60, as shown, or the 3-dimensional grid pattern may be irregular. Conductive filaments 11 may be dispersed homogeneously or heterogeneously. Conductive filaments 11 are dispersed so an electrical pulse from a PPD drill bit may flow through conductive filament 11, heat it, and fragment blank 60.

Figure 7:
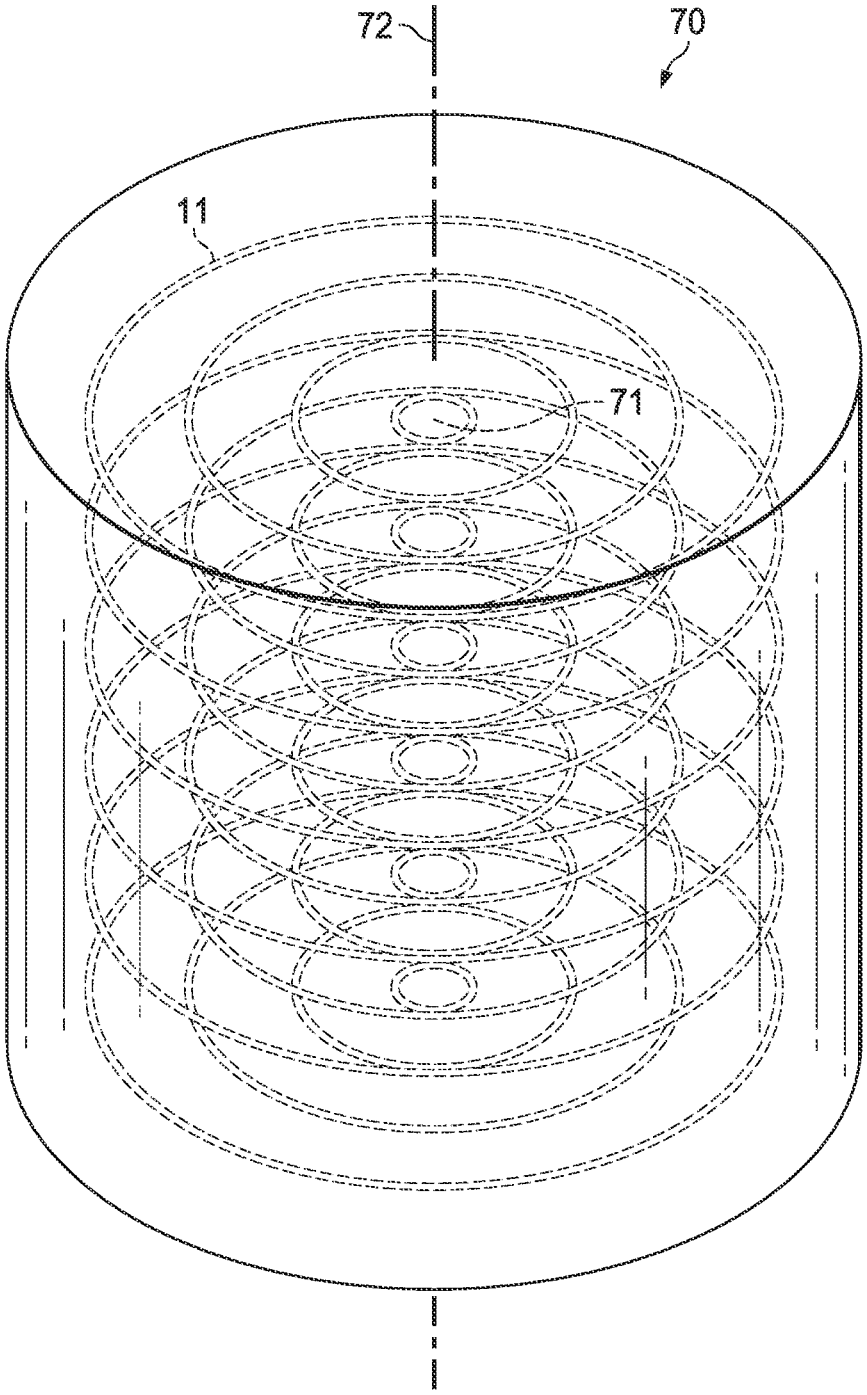
FIG. 7 is a perspective view of a blank containing conducting filaments.

FIG. 7 is a perspective view of blank 70. Blank 70 includes non-conductive material with conductive filaments 11 dispersed in the non-conductive material. Conductive filaments 11 in blank 70 may be dispersed in rings about a point 71 on cylinder axis 72, or the rings may be dispersed around other points within blank 70. Conductive filaments 11 may be dispersed homogeneously or heterogeneously. Conductive filaments 11 are dispersed so an electrical pulse from a PPD drill bit may flow through conductive filament 11, heat it, and fragment blank 70.

FIG. 8 is a perspective view of blank 80. Blank 80 includes non-conductive material with conductive filaments 11 dispersed in the non-conductive material. Conductive filaments 11 in blank 80 radiate out from point 81. The conductive filaments 11 may be regularly or irregularly spaced. Point 81 may be on the cylinder axis 82, as depicted, or may be at any other position. Conductive filaments 11 may be dispersed homogeneously or heterogeneously. Conductive filaments 11 are dispersed so an electrical pulse from a PPD drill bit may flow through conductive filament 11, heat it, and fragment blank 80.

FIG. 9 is a perspective view of blank 90. Blank 90 includes non-conductive material with conductive filaments 11 dispersed in the non-conductive material. Conductive filaments 11 in blank 90 are dispersed irregularly and without pattern through blank 90. Conductive filaments 11 may be dispersed homogeneously or heterogeneously. Conductive filaments 11 are dispersed so an electrical pulse from a PPD drill bit may flow through conductive filament 11, heat it, and fragment blank 90.

The present disclosure also provides PPD-suitable casing equipment form from a billet as described herein, such as wellbore-cementing plugs, including top plugs and bottom plugs. The plugs may be cylindrical and adapted to the casing. Any PPD-suitable well-bore cementing plugs may be formed from any of the blanks of FIGS. 1-9 or otherwise as disclosed herein.

FIG. 10 is a schematic view of PPD-suitable top plug 100. Top plug 100 includes conductive filaments 11. Top plug 100 may include both an inner body 101 and an outer body 102 as depicted, or it may only have a single body. A body may include non-conductive materials and conductive filaments in portions to be fragmented by the PPD bit. Both inner body 101 and outer body 102 may include the same non-conductive material, or different non-conductive materials. Outer body 102 may have fins 103 to clear material from the casing as top plug 100 descends. Top plug 100 may be formed by machining a blank, or it may be formed by other methods, such as molding. Conductive filaments 11 may be dispersed in top plug 100 as described in FIGS. 1-9, or in other suitable ways. Conductive filaments may be dispersed homogeneously or heterogeneously in top plug 100. Top plug 100 may have a hollow interior defined by a body, such as the inner body 101, as depicted, or top plug 100 may be solid.

FIG. 11 is a schematic view of bottom PPD-suitable plug 110. Bottom plug 110 includes conductive filaments 11. Bottom plug 110 may include both an inner body 111 and an outer body 112 as depicted, or it may only have a single body. Inner body 111 and outer body 112 may include non-conductive material. Both inner body 111 and outer body 112 may include the same non-conductive material, or different non-conductive material. Outer body 112 may have fins 113 to clear material from the casing as bottom plug 110 descends. Bottom plug 110 may be formed by machining a blank, or it may be formed by other methods, such as molding. Conductive filaments 11 may be dispersed in bottom plug 110 as described in FIGS. 1-9, or in other suitable ways. Conductive filaments 11 may be dispersed homogeneously or heterogeneously in bottom plug 110. Bottom plug 110 may have a hollow interior defined by a body, such as inner body 111, as depicted, or bottom plug 110 may be solid. Bottom plug 110 may also have rupturable diaphragm 114, located at an end of the hollow interior, which ruptures on application of sufficient pressure and allows fluid to pass through bottom plug 110.

The present disclosure also provides wellbore-cementing float equipment. Float collars and float shoes are examples of float equipment. Any wellbore-cementing float equipment may be formed from any of the blanks of FIGS. 1-9 or otherwise as disclosed herein. Float collars and float shoes may have casing segments with PPD-drillable material affixed to the casing segment inner surface. A check valve may be attached to the drillable material, which allows material to pass downhole through the float collar or float shoe, but prevents the material from flowing back uphole. The check valve may also be drillable.

FIG. 12 is a schematic view of float collar 120. Float collar 120 includes conductive filaments 11, drillable material 121, casing segment 122, and casing segment inner surface 124. Drillable material 121 includes non-conductive material and conductive filaments 11 dispersed in the non-conductive material. The non-conductive material may be any such material identified herein, but frequently it includes concrete. Conductive filaments 11 may be dispersed in drillable material 121 as described in FIGS. 1-9, or in other suitable ways. Conductive filaments 11 may be dispersed homogeneously or heterogeneously in drillable material 121. Drillable material 121 is attached to the inner surface 124 and holds check valve 123 in place. Check valve 123 allows fluid to pass downhole through float collar 120 but does not allow the fluid to travel back uphole. Check valve 123 may also include non-conductive material and conductive filaments 11 dispersed in the non-conductive material. Inner surface 124 may electrically insulate casing segment 122, which prevents electrical discharges from a PPD drill bit from arcing to casing segment 122. Inner surface 124 may be a layer of, coating on, or homogenous part of casing segment 122. Inner surface 124 may cover only casing 122 near the float collar, as depicted in FIG. 12, or inner surface 124 may cover any other portion of casing 122. Inner surface 124 may include any suitable material, such as a polymer, like plastics, resins, or rubber, or a composite material, such as fiberglass.

Figure 13:
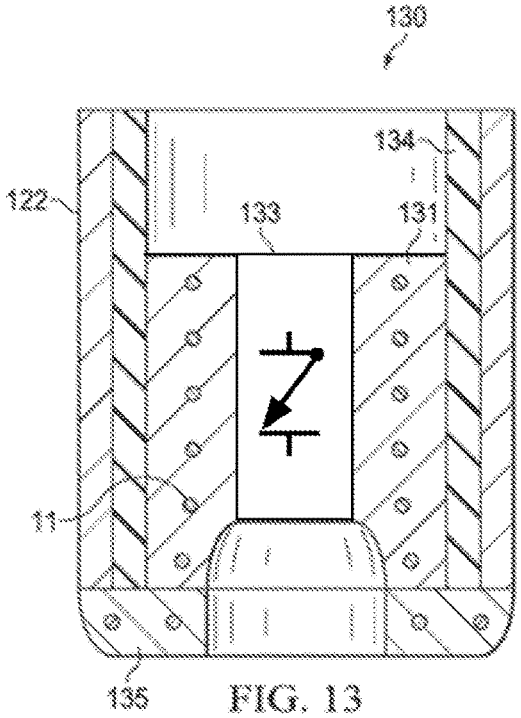
FIG. 13 is a cross section view of a float shoe containing conductive filaments.

FIG. 13 is a schematic view of float shoe 130. Float shoe 130 includes drillable material 131, casing segment 122, and casing segment inner surface 134. Drillable material 131 includes non-conductive material and conductive filaments 11 dispersed in the non-conductive material. Conductive filaments 11 may be dispersed in drillable material 131 as described in FIGS. 1-9, or in other suitable ways. Conductive filaments 11 may be dispersed homogeneously or heterogeneously in drillable material 131. Drillable material 131 is attached to inner surface 134 and holds check valve 133 in place. Check valve 133 allows fluid to pass downhole through float shoe 130 but does not allow fluid to travel back uphole. Check valve 133 may also include non-conductive material and conductive filaments 11 dispersed in the non-conductive material. Inner surface 134 may electrically insulate casing segment 122, which prevents electrical discharges from a PPD drill bit from arcing to casing segment 122. Inner surface 134 may be a layer of, coating on, or homogenous part of casing segment 122. Inner surface 134 may cover only casing 122 near the float collar, as depicted in FIG. 12, or inner surface 134 may cover any other portion of casing segment 122. Inner surface 134 may include any suitable material, such as a polymer, such as plastics, resins, or rubber, or a composite material, such as fiberglass. Float shoe 130 may also have shoe 135 attached to the bottom of casing segment 122. Shoe 135 protects the bottom of float shoe 130 from the wellbore, and the rounded edges of shoe 135 help guide the casing string down the wellbore. Shoe 135 may include shoe non-conductive material and shoe conductive filaments 11 dispersed in the shoe non-conductive material. Shoe non-conductive material may be different from the non-conductive material of the drillable material, shoe conductive filaments may be different from the conductive filaments of the drillable material, or both.

The present disclosure also provides PPD-compatible wellbore-cementing systems. Systems may include a float shoe at the bottom of the casing string that includes a check valve to prevent fluid pumped past the float shoe from flowing back uphole. Systems may include a float collar that includes a check valve to prevent fluid pumped past the float collar from flowing back uphole. Systems may include a bottom plug to maintain separation between the cement pumped into the casing and the drilling fluid already in the casing. Systems may include a top plug to maintain separation between the cement pumped into the casing and the fluid pumped into the casing after the cement. Each of the float shoe, float collar, top plug, and bottom plug, or any combination thereof, may include non-conductive materials with conductive filaments dispersed in the non-conductive material, which allows it to be drilled out with PPD. Systems may include a PPD drill.

Figure 14A:
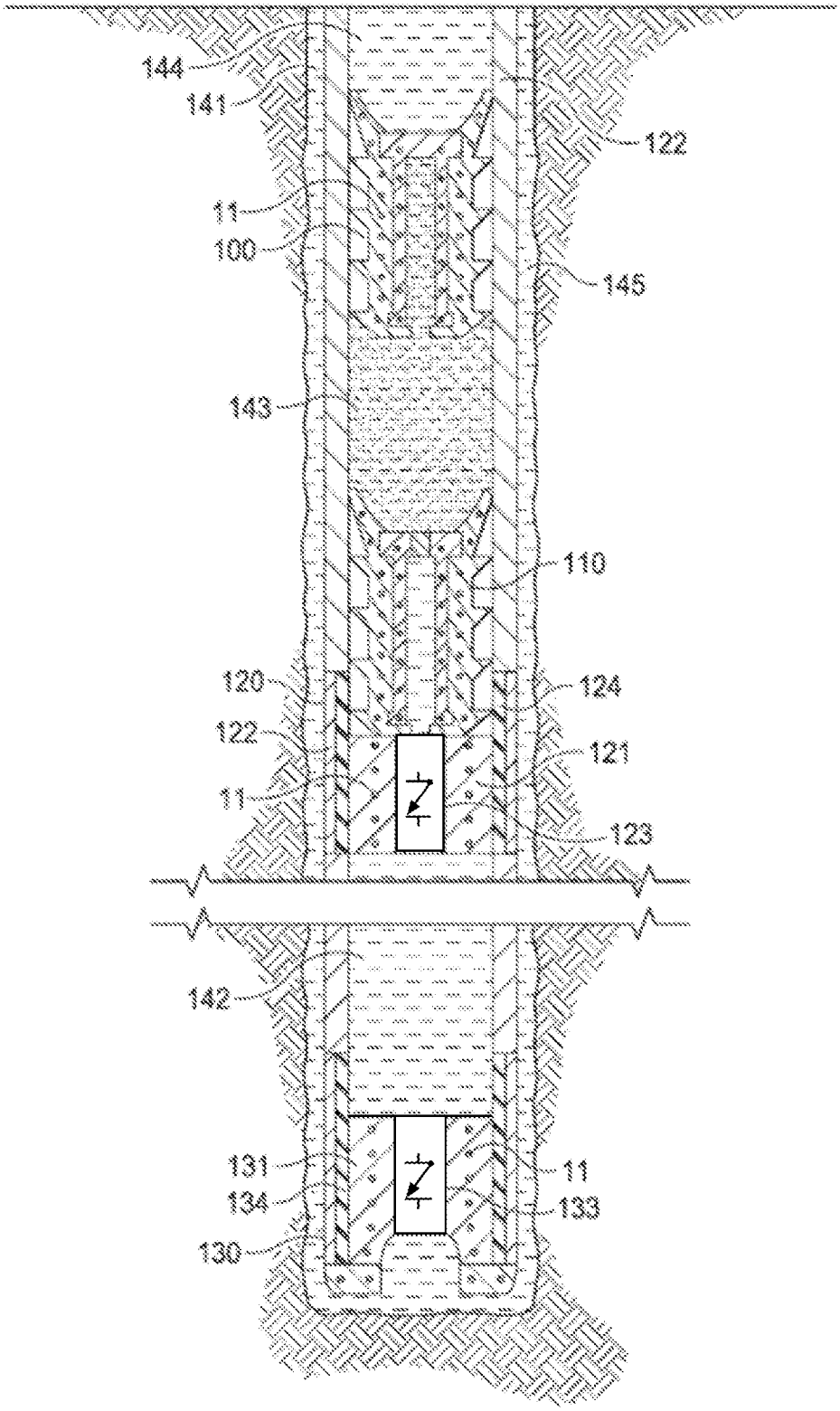
FIG. 14A shows the system during cementing.
Figure 14B:
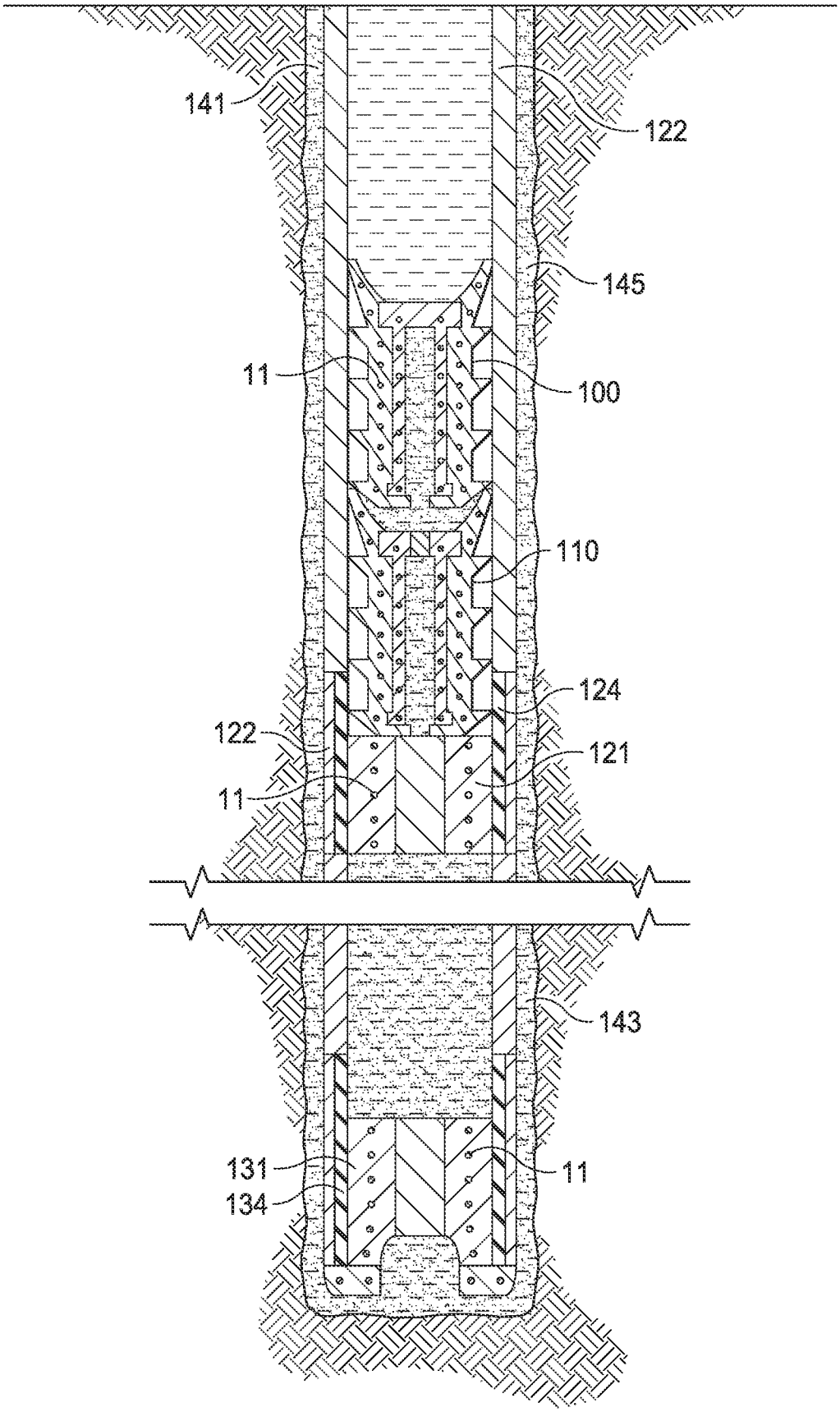
FIG. 14B shows the system after cementing.

FIG. 14A-B are schematic views of a PPD-compatible wellbore-cementing system. FIG. 14A shows the cementing system after top plug 100 is inserted into casing segment 122 but before cement 143 has entered annulus 145. Casing segment 122 may be positioned in wellbore 141. Bottom plug 110 rests on the drillable material 121 of float collar 120. Bottom plug 110 separates drilling fluid 142 from cement 143. Top plug 100 separates cement 143 from pump fluid 144. Pump fluid 144 pushes cement 143 into annulus 145. Check valve 123 on float collar 120 and check valve 133 on float shoe 130 prevent the cement from traveling back up once it has passed check valves 123 and 133 and entered annulus 145. Conductive filaments 11 allow the casing equipment to be drilled by a PPD system. Inner surfaces 124 and 134 may electrically insulate casing 122 to prevent the PPD drill bit electric discharges from arcing to casing segment 122 while the PPD drill bit drills out drillable material 121 and 131. Float-collar non-conductive material may be different from the non-conductive material of the drillable material, float-collar conductive filaments may be different from the conductive filaments of the drillable material, or both.

FIG. 14B is a schematic view of a wellbore-cementing system after bottom plug 110 has ruptured and annulus 145 has filled with cement 143. Top plug 100, bottom plug 110, float collar drillable material 121, and float shoe drillable material 131 are in the path of wellbore 141 and may be drilled out. Conductive filaments 11 allow the casing equipment in the path of the wellbore to be drilled out by a PPD system. Inner surfaces 124 and 134 may electrically insulate casing segment 122 to prevent the PPD drill bit electric discharges from arcing to casing segment 122 while the PPD drill bit drills out drillable material 121 and 131.

Figure 15:
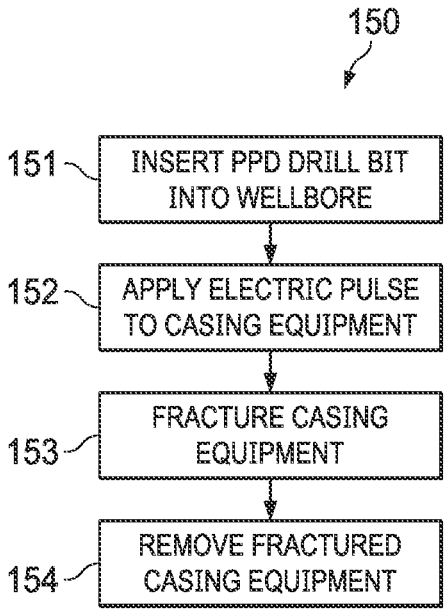
FIG. 15 is a flowchart of a PPD-compatible wellbore-drillout method.

FIG. 15 is a flowchart describing PPD-compatible wellbore-drillout method 150. In step 151 of method 150, the PPD drill bit is lowered into the wellbore containing the PPD-compatible casing equipment. As described previously, the PPD-compatible casing equipment includes both non-conductive material and conductive filaments distributed in the non-conductive material. In step 152, the PPD drill bit applies an electrical pulse to the PPD-compatible casing equipment that flows through at least one of the conductive filaments, heating it. In step 153, the heated conductive filament fractures the non-conductive material, breaking the PPD-compatible casing equipment into smaller pieces. Finally, in step 154, the smaller pieces of fractured PPD-compatible casing equipment are swept away by drilling fluid pumped into the wellbore.

The present disclosure further includes variations of the materials, blanks, casing equipment, and methods disclosed herein. For example, the non-conductive material with conductive filaments may be formed by dispersing conductive filaments homogeneously in the non-conductive material, or only in some portions of the non-conductive material. Different dispersions will result in different properties. A non-conductive material with fewer conductive filaments may fragment into larger pieces, for instance. A non-conductive material with more conductive filaments may require stronger electrical pulses to heat the conductive filaments. Conductive filaments may be dispersed in a pattern that causes the non-conductive material to fragment into specific shapes.

The present disclosure includes a plug for cementing a wellbore. The plug may include at least one body including a non-conductive material with conductive filaments dispersed within the non-conductive material.

According to further embodiments, which may be combined with one another and with any disclosure of a plug herein, unless clearly mutually exclusive:

- i) the plug may include an inner body and an outer body;
- i-a) the plug may further include fins that project from the outer body of the plug;
- ii) the plug may include a cylinder;
- iii) at least one body of the plug may further define a hollow interior;
- iii-a) the plug may further include a rupturable diaphragm at an end of the hollow interior;
- iv) the non-conductive material may include at least one of the group consisting of concrete, ceramic, a composite material, fiberglass-reinforced plastic, a polymers, polyurethane, resin, plastic, rubber, and any combinations thereof;
- iv) the conductive filaments may include at least one of the group consisting of aluminum, copper, iron, beryllium, titanium, gold, magnesium, manganese, nickel, platinum, tungsten, zinc, silver, alloys thereof, and any combinations thereof;
- v) the conductive filaments may be dispersed homogeneously in the non-conductive material;
- vi) the conductive filaments may be dispersed in a pattern in the non-conductive material;
- vi-a) the pattern may be a 2-dimensional pattern;
- vi-b) the pattern may be a 3-dimensional pattern;
- vii) the conductive filaments may be dispersed heterogeneously in the non-conductive material.

The present disclosure includes float equipment for cementing a wellbore. The float equipment may include a casing segment including an inner surface, drillable material affixed to the inner surface of the casing segment, and a check valve attached to the drillable material. The drillable material may include a non-conductive material and conductive filaments dispersed within the non-conductive material.

According to further embodiments, which may be combined with one another and with any disclosure of a blank herein, unless clearly mutually exclusive:

i) the float equipment may further include a rounded shoe attached to the bottom of the casing segment, the rounded shoe including a shoe non-conductive material and shoe conductive filaments dispersed within the shoe non-conductive material.

i-a) the shoe non-conductive material may be different from the non-conductive material of the drillable material, shoe conductive filaments may be different from the conductive filaments of the drillable material, or both.

ii) the check valve may further include a check-valve non-conductive material and check-valve conductive filaments dispersed within the check-valve non-conductive material.

ii-a) check valve non-conductive material may be different from the non-conductive material of the drillable material, the check valve conductive filaments may be different from the conductive filaments of the drillable material, or both.

iii) the non-conductive material may include at least one of the group consisting of concrete, ceramic, a composite material, fiberglass-reinforced plastic, a polymers, polyurethane, resin, plastic, rubber, and any combinations thereof;

iv) the conductive filaments may include at least one of the group consisting of aluminum, copper, iron, beryllium, titanium, gold, magnesium, manganese, nickel, platinum, tungsten, zinc, silver, alloys thereof, and any combinations thereof;

v) the conductive filaments may be dispersed homogeneously in the non-conductive material;

vi) the conductive filaments may be dispersed in a pattern in the non-conductive material;

vi-a) the pattern may be a 2-dimensional pattern;

vi-b) the pattern may be a 3-dimensional pattern;

vii) the conductive filaments may be dispersed heterogeneously in the non-conductive material.

The plugs and float collars disclosed above may be used in combination with one another in a wellbore being drilled using PPD.

Although the present disclosure has been described with several embodiments, various changes and modifications may be suggested to one skilled in the art. It is intended that the present disclosure encompasses such various changes and modifications as falling within the scope of the appended claims.

The invention claimed is:

1. A plug for cementing a wellbore, the plug comprising:

at least one body including an inner body including a first non-conductive material with conductive filaments dispersed within the first non-conductive material; and an outer body including a second non-conductive material with conductive filaments dispersed within the second non-conductive material, wherein the second non-conductive material is different from the first non-conductive material.

2. The plug of claim 1, wherein the plug is cylindrical.

3. The plug of claim 2, wherein the plug further comprises a rupturable diaphragm at an end of the hollow interior.

4. The plug of claim 1, further comprising fins that project from the outer body of the plug.

5. The plug of claim 1, wherein the first and second non-conductive materials comprise at least two of the group consisting of concrete, ceramic, a composite material, fiberglass-reinforced plastic, a polymers, polyurethane, resin, plastic, rubber, and any combinations thereof.

6. The plug of claim 1, wherein the conductive filaments comprise at least one of the group consisting of aluminum, copper, iron, beryllium, titanium, gold, magnesium, manganese, nickel, platinum, tungsten, zinc, silver, alloys thereof, and any combinations thereof.

7. The plug of claim 1, wherein the conductive filaments are dispersed homogeneously in the first and second non-conductive materials.

8. The plug of claim 1, wherein the conductive filaments are dispersed in a 2-dimensional or 3-dimensional pattern in the first and second non-conductive materials.

9. The plug of claim 1, wherein the conductive filaments are dispersed heterogeneously in the first and second non-conductive materials.

10. Float equipment for cementing a wellbore, the float equipment comprising:

a casing segment including an inner surface;

drillable material affixed to the inner surface of the casing segment, the drillable material including a non-conductive material; and conductive filaments dispersed within the non-conductive material; and a check valve attached to the drillable material, the check valve including a check-valve non-conductive material and check-valve conductive filaments dispersed within the check-valve non-conductive material.

11. The float equipment of claim 10, further comprising a rounded shoe attached to the bottom of the casing segment, the rounded shoe comprising:

a shoe non-conductive material; and shoe conductive filaments dispersed within the shoe non-conductive material.

12. The float equipment of claim 11, wherein the shoe non-conductive material is different from the non-conductive material of the drillable material, the shoe conductive filaments are different from the conductive filaments of the drillable material, or both.

13. The float equipment of claim 10, wherein the check valve non-conductive material is different from the non-conductive material of the drillable material, the check valve conductive filaments are different from the conductive filaments of the drillable material, or both.

14. The float equipment of claim 10, wherein the non-conductive material of the drillable material comprises at least one of the group consisting of concrete, ceramic, a composite material, fiberglass-reinforced plastic, a polymers, polyurethane, resin, plastic, rubber, and any combinations thereof.

15. The float equipment of claim 10, wherein the conductive filaments of the drillable material comprise at least one of the group consisting of aluminum, copper, iron, beryllium, titanium, gold, magnesium, manganese, nickel, platinum, tungsten, zinc, silver, alloys thereof, and any combinations thereof.

16. The float equipment of claim 10, wherein the conductive filaments of the drillable material are dispersed homogeneously in the non-conductive material of the drillable material.

17. The float equipment of claim 10, wherein the conductive filaments of the drillable material are dispersed in a 2-dimensional or 3-dimensional pattern in the non-conductive material of the drillable material.

18. The float equipment of claim 10, wherein the conductive filaments of the drillable material are dispersed heterogeneously in the non-conductive material of the drillable material.

* * * * *